US008291620B2

(12) United States Patent
Valaas

(10) Patent No.: US 8,291,620 B2
(45) Date of Patent: Oct. 23, 2012

(54) SKI BOOT SOLE GUARD

(76) Inventor: Laura Aubrey Valaas, Wenatchee, WA (US)

( * ) Notice: Subject to any disclaimer, the term of this patent is extended or adjusted under 35 U.S.C. 154(b) by 343 days.

(21) Appl. No.: 12/804,227

(22) Filed: Jul. 16, 2010

(65) Prior Publication Data

US 2012/0011746 A1 Jan. 19, 2012

(51) Int. Cl.
*A43C 13/00* (2006.01)

(52) U.S. Cl. ..... 36/117.1; 36/117.3; 36/132

(58) Field of Classification Search ..... 36/15, 117.1, 36/117.3, 117.4, 132, 135
See application file for complete search history.

(56) References Cited

U.S. PATENT DOCUMENTS

| | | | |
|---|---|---|---|
| 2,603,393 | A | 7/1952 | Oblusteel |
| 2,963,165 | A | 12/1960 | Steiner |
| 3,301,369 | A | 1/1967 | Karn, Jr. |
| 3,370,766 | A | 2/1968 | Woolworth |
| 3,425,567 | A | 2/1969 | Murray |
| 3,497,891 | A | 3/1970 | Voster et al. |
| 3,570,681 | A | 3/1971 | Kinshofer |
| 3,600,734 | A | 8/1971 | Pollinger |
| 3,608,795 | A | 9/1971 | Klein et al. |
| 3,653,565 | A | 4/1972 | McAusland |
| 3,721,373 | A | 3/1973 | Penniman |
| 3,722,652 | A | 3/1973 | Busch et al. |
| 3,731,348 | A | 5/1973 | Luchne |
| 3,775,794 | A | 12/1973 | Fisher |
| 3,794,226 | A | 2/1974 | Penniman |
| 3,826,022 | A | 7/1974 | Grzech |
| 3,826,378 | A | 7/1974 | Novak |
| 3,841,648 | A | 10/1974 | Meyer |
| 3,965,586 | A | 6/1976 | Roosli |
| 3,999,773 | A | 12/1976 | Shuttleworth |
| 4,000,909 | A | 1/1977 | Coale |
| 4,033,460 | A | 7/1977 | Alexandre |
| D245,892 | S | 9/1977 | Yocum |
| 4,047,726 | A | 9/1977 | Kokeisl |
| 4,055,005 | A | 10/1977 | Meinhart |
| 4,062,453 | A | 12/1977 | Gorlach |
| D247,415 | S | 3/1978 | Harper |
| 4,084,867 | A | 4/1978 | Putt et al. |

(Continued)

FOREIGN PATENT DOCUMENTS

WO WO 2012/008988 1/2012

OTHER PUBLICATIONS http://www.skadinordic.com, Jul. 28, 2011.

(Continued)

*Primary Examiner* — Marie Patterson

(57) ABSTRACT

A removable, one-piece sole guard for preventing crevices on a ski boot sole from filling with snow, ice, and debris includes: (a) a head portion including a substantially planar top head surface that is substantially parallel to the bottom surface; (b) a body portion adjacent the head portion, which includes a substantially planar top body surface that is substantially parallel to the bottom surface; (c) at least one pin groove between the head portion and the body portion that opens to the top of the sole guard; (d) two opposite, substantially parallel guard sides; and (e) projections extending down from the bottom surface. A two-pin sole guard for a ski boot with at least two boot sole pins includes a second pin groove that opens to the rear. This simplified abstract is not intended to limit, and should not be interpreted as limiting, the scope of the claims.

20 Claims, 11 Drawing Sheets

U.S. PATENT DOCUMENTS 4,126,255 A 11/1978 Olson
4,129,312 A 12/1978 Loffelholz
4,145,062 A 3/1979 Stiemert
4,145,063 A 3/1979 Knapp et al.
4,160,301 A 7/1979 Woolley
4,173,811 A 11/1979 Kokeisl
4,221,024 A 9/1980 Becker
4,222,490 A 9/1980 Wood, Jr.
D257,523 S 11/1980 Allsop
4,244,498 A 1/1981 Copp
4,248,365 A 2/1981 Jacobs
4,268,050 A 5/1981 Kennedy, Sr.
4,351,120 A * 9/1982 Dalebout ..... 36/117.3
4,508,229 A 4/1985 Yost, Jr.
4,530,168 A 7/1985 Petre
4,531,644 A 7/1985 Margulies
4,537,436 A 8/1985 Pfortmiller
4,624,496 A 11/1986 Bengtson
4,629,103 A 12/1986 Miller
4,635,800 A 1/1987 Stempin
4,678,087 A 7/1987 York
4,696,504 A 9/1987 Roberts, Jr.
4,718,138 A 1/1988 Brown et al.
4,720,932 A 1/1988 Bovino
4,733,897 A 3/1988 Schuetzeberg
4,761,029 A 8/1988 Woodcock
4,779,362 A 10/1988 Citrowske
D299,100 S 12/1988 Martinell et al.
4,790,462 A 12/1988 Kawaguchi
4,793,496 A 12/1988 Wait
4,815,642 A 3/1989 Ray
4,867,359 A 9/1989 Donovan
4,900,061 A 2/1990 Kozma, Jr.
4,927,176 A 5/1990 King et al.
4,942,994 A 7/1990 Sterenberg
4,958,445 A * 9/1990 Brisco ..... 36/7.5
D316,620 S 4/1991 Magor
5,007,185 A * 4/1991 Lazarski ..... 36/135
5,042,839 A 8/1991 Ciari
5,056,820 A 10/1991 Des Prez
5,147,098 A 9/1992 McCrink
5,156,418 A 10/1992 Kelly
5,171,052 A 12/1992 Cunningham
5,193,694 A 3/1993 Wave
5,197,760 A 3/1993 Schollenberger
5,285,939 A 2/1994 Hogan
5,307,944 A 5/1994 Reedy
5,358,277 A 10/1994 Klement, Jr.
5,398,984 A 3/1995 Elder
5,449,230 A 9/1995 Murray
5,487,581 A 1/1996 Carmo et al.
5,524,912 A 6/1996 Laub et al.
5,599,052 A 2/1997 Van Davelaar
D378,245 S 3/1997 DeMier
5,697,660 A 12/1997 Smetz
5,713,097 A 2/1998 Brown
5,806,691 A 9/1998 Nelson
5,884,781 A 3/1999 Ehrhart
5,960,568 A 10/1999 Bell et al.
6,044,578 A * 4/2000 Kelz ..... 36/7.5
6,050,873 A 4/2000 Reisman
6,092,306 A * 7/2000 Newton-Dunn ..... 36/7.1 R
6,247,739 B1 6/2001 Lyon
6,273,272 B1 8/2001 Hake
D453,667 S 2/2002 Wishnick
6,446,363 B1 * 9/2002 Artus ..... 36/117.3
6,454,335 B1 9/2002 Wishnick
6,827,226 B2 12/2004 Coulson
7,290,358 B2 11/2007 Francis
7,966,752 B2 * 6/2011 Grandin et al. ..... 36/117.5
2004/0074113 A1 4/2004 Kim et al.
2005/0067450 A1 3/2005 Trejo et al.
2005/0194803 A1 9/2005 Perry
2006/0273128 A1 12/2006 Balakier
2007/0051761 A1 3/2007 McNeal
2007/0204486 A1 9/2007 Fenato
2008/0011694 A1 1/2008 Garceau
2008/0079238 A1 4/2008 Geisler et al.
2008/0257925 A1 10/2008 Brooks

OTHER PUBLICATIONS http://www.customskitools.com/custom-ski-accessories/custom-cross-country-ski-ties/, Jan. 17, 2011.
http://www.rei.com, Jul. 28, 2011.
http://www.skibones.com, Jul. 28, 2011.
http://www.swixracing.us/nordic/products.cat.php?rid=42010-2011 Product Catalog, p. 63, Jan. 17, 2011.
http://www.toko.ch/en/apps/productDetail.html ToKo accessories—Ski Tie Nordic (24 pcs.), Jan. 13, 2011.
http://www.toko.ch/en/apps/productDetail.html ToKo accessories—Ski Clip Nordic (60 pcs.), Jan. 13, 2011.
International Search Report and Written Opinion of International Search Authority, PCT/US2011/00176, filed Jan. 31, 2011.
http://www.toko.ch/en/products/tools/accessories/skiholder-belt, Feb. 22, 2011.
http://www.cozywinters.com/storage, Feb. 22, 2011.
http://www.amazon.com/indoorskistorage, Feb. 22, 2011.
http://www.logfurnitureplace.com/product_info.php?, Feb. 22, 2011.
http://customskities.com, Aug. 1, 2011.
http://skitie.com, Aug. 1, 2011.
http://www.nordicskiersports.com/xc/swix-ski-straps-r0397.html, Aug. 1, 2011.
http://www.alpinasports.com/index.php/nordic-rac/category/boots, Aug. 1, 2011.
http://www.rossignol.com/US/US/nordic-men-boots-skating.html, Aug. 1, 2011.
http://www.madshus.com/boots, Aug. 1, 2011.
http://www.fischersports.com/en/nordic/products/boots/race-classic, Aug. 1, 2011.
http://www.salomon.com/us/#/nordic/boots, May 25, 2010.
http://www.skitraxx.com, May 25, 2010.

* cited by examiner

SKI BOOT SOLE GUARD

BACKGROUND OF THE INVENTION

1. Technical Field

The present invention relates to a removable, one-piece sole guard that fits onto the sole of a ski boot for preventing snow, ice, and debris from accumulating in recess(es) on the ski boot sole while the user is walking around prior to skiing.

2. Background Information

One of the more annoying tasks that a skier must perform just prior to putting on skis is scraping packed snow and ice from crevices on the soles of his or her ski boots. This time consuming task can, for example, interfere with the concentration and mental preparation of a cross country skier just before competing in a race. If the scraping task is not done properly, though, snow, ice, and other debris packed into the crevices on the ski boot soles can prevent a proper fit to the ski. The compaction problem can vary in severity, depending on snow and ice conditions, whether there are pebbles or other small particles underfoot, how long the skier has been walking around in the ski boots, etc. A compacted ski boot will not lock onto ski bindings. Worse, an ill fit can cause a skier, whether competitive or pleasure, to fall while skiing and sustain an injury.

Because cross country skiing uses a free-heel binding system, the functionality of the ski boot is decreased by wear on the boot sole, which causes the boot to no longer match the binding plate. This can cause a skier's boot to slip off or improperly impact the binding plate, especially on sharp corners or where lateral force is applied. Besides an ill-worn boot being dangerous, many skiers become attached to a favorite pair of boots, which can be quite expensive, and hate to discard them. Protecting the original shape and thickness of the boot sole is vital for proper functioning of the boot and binding system. Also, the ski boot sole guard of the present invention extends slightly below the boot sole in order to prevent wear on the ski boot sole and prolong the life of the boot.

Packed snow, ice, and/or small debris must be scraped out of a boot sole before a ski boot will fit properly in ski bindings. It can be particularly difficult for adult or child skiers with poor flexibility or coordination to remove snow, ice, and debris compacted on their boot soles. The ski boot sole guard of the present invention alleviates the compaction problem by preventing snow, ice, and debris from accumulating under it on the sole of a ski boot or a similar article of footwear. This ski boot sole guard saves the skier time and also reduces the likelihood of accidents caused by improperly locked skis. The present ski boot sole guard is easy to place and takes seconds to remove. The preferred small, inexpensive ski boot guard of the present invention can even be removed using a ski pole, so that the skier need not bend over or sit down to remove it. The sole guard of the present invention can also be adapted for use by snowboarders or the like.

BRIEF SUMMARY OF THE INVENTION

The present invention is a removable ski boot sole guard that fits into a recess on a sole of a conventional ski boot for use while the user is walking around prior to or just after skiing. The boot sole guard includes: (a) a head portion including a substantially planar top head surface that is substantially parallel to an opposite, bottom surface of the sole guard; (b) a body portion adjacent the head portion, which includes a substantially planar top body surface that is substantially parallel to an opposite, bottom surface of the sole guard; (c) at least one pin groove; (d) two opposite, substantially parallel guard sides, which are substantially perpendicular to the top body surface; and (e) projections extending in a downward direction from the bottom surface of the sole guard. In a two-pin boot sole guard, which fits into a recess on a sole of a ski boot with at least two boot pins, the first pin groove extends between the head portion and the body portion, and the second pin groove extends in from a rear end surface of the sole guard at a different angle from the first. The second pin groove preferably extends substantially perpendicular to the first pin groove. The projections are preferably toothed segments or other traction-improving features. The rear end of the sole guard preferably includes a scraper blade edge for manual use in scraping away snow and ice from a ski boot.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
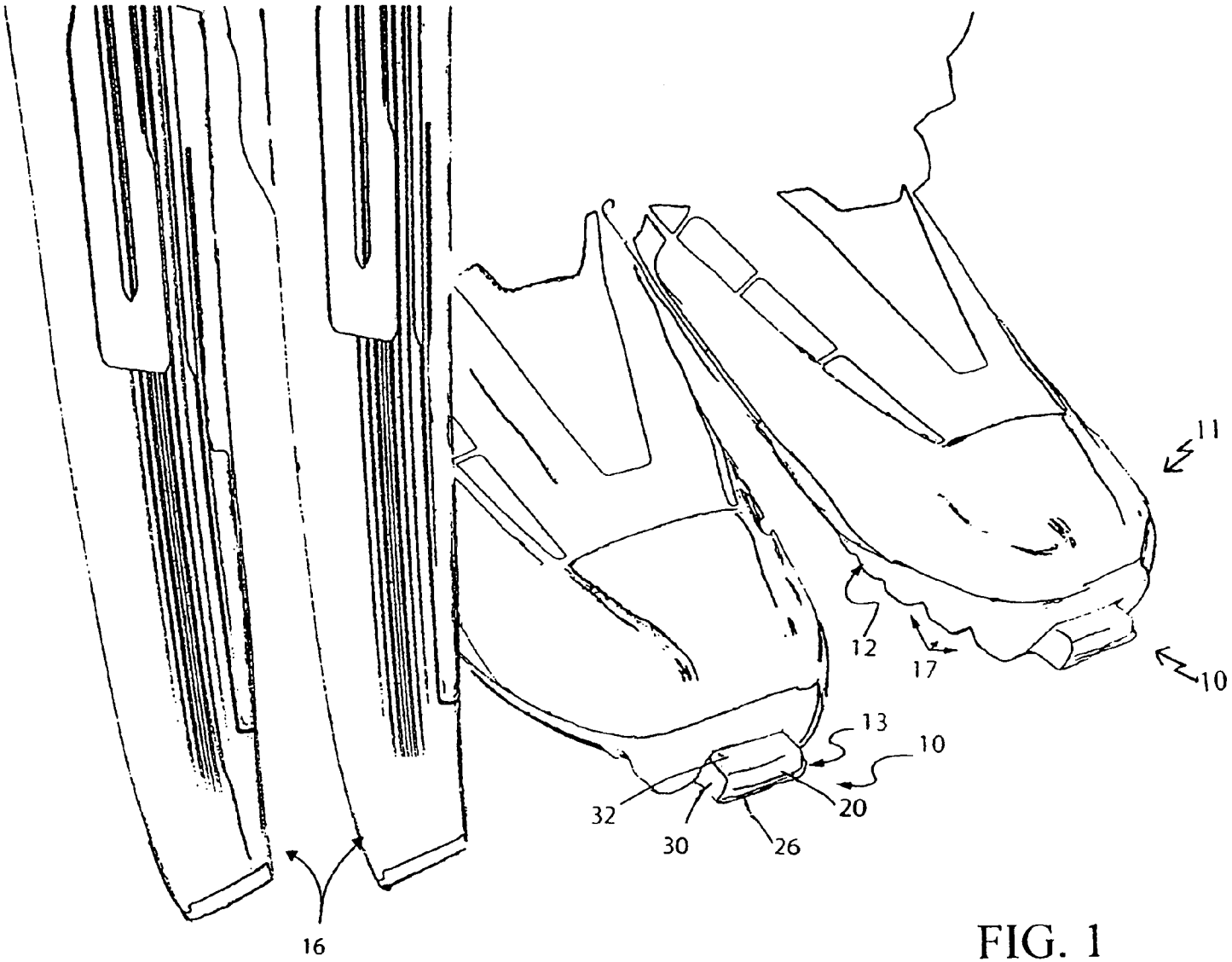
FIG. 1 shows a perspective view of a ski boot sole guard according to the present invention, shown in use on ski boots.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, a device embodying the principles and concepts of the present invention and generally designated by the reference numeral 10 will now be described.

Figure 2:
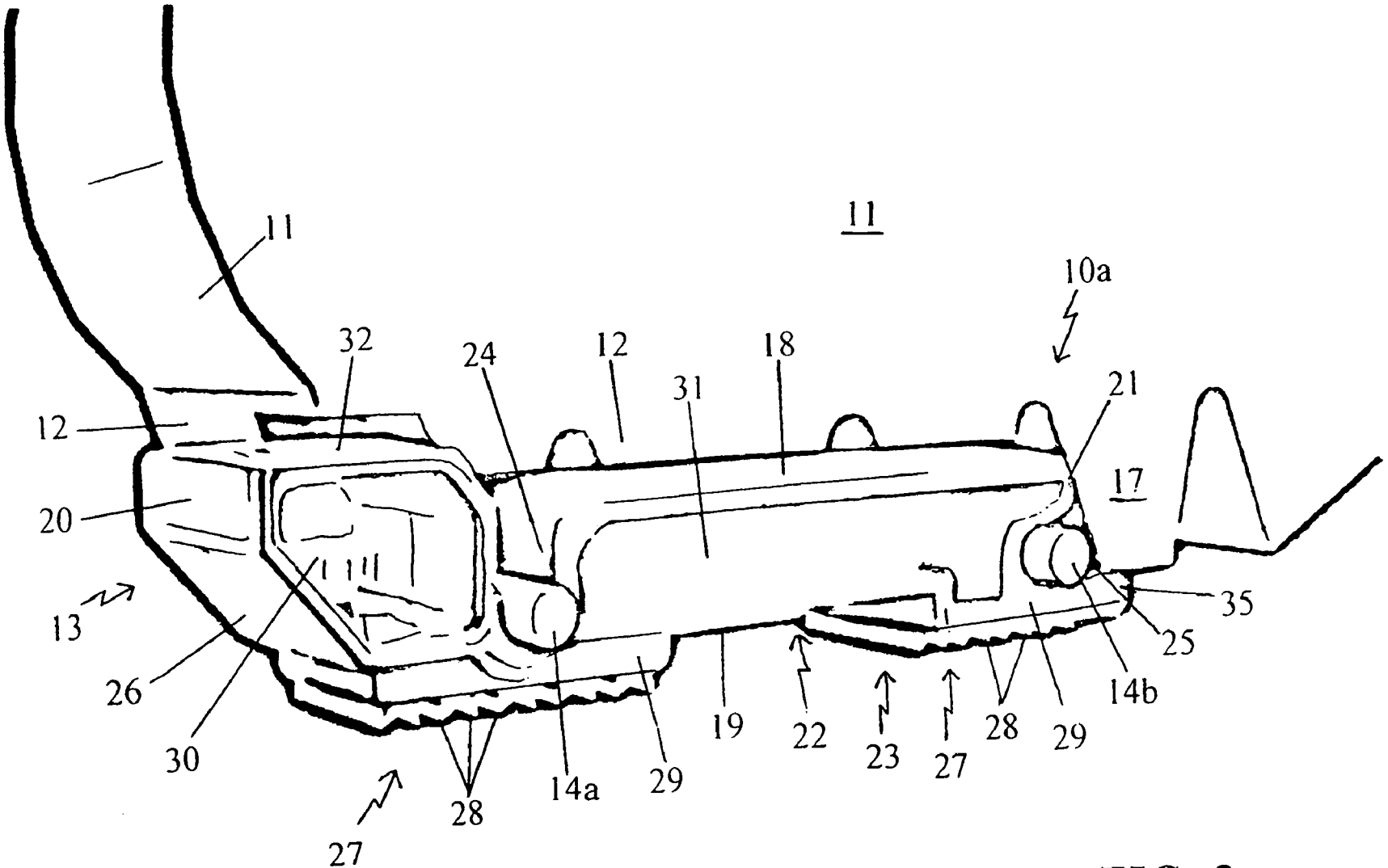
FIG. 2 is a perspective view of a two-pin ski boot sole guard according to the present invention, shown on a cross-sectioned ski boot for purposes of illustration.

Turning first to FIGS. 1 and 2, a one-piece, removable ski boot sole guard 10 according to the present invention is clasped on the sole 12 of a conventional ski boot 11 for use. A head portion 13 of the sole guard 10 of FIGS. 1 and 2 is exposed at the toe of the ski boot 11, where it is visible to the wearer and bystanders. The exposed head portion 13 of the sole guard 10 extends forward of the ski boot 11 only a short distance, preferably between about 0.5 and about 1.5 centimeter, as seen in FIGS. 1 and 2, so that it does not interfere with the user's stride.

Even though the various ski boot manufacturing companies currently manufacture ski boots to comply with regulations, different brands of ski boots tend to differ somewhat in sole conformation. Several similar versions of the boot sole guard 10 are available to accommodate the different types of ski boot soles. The boot sole guards 10 are preferably color coded to indicate to a user the brand of ski boot 11 each sole guard 10 fits on.

Some ski boots 11 have one pin, some two pins, and some three pins on the sole, and boot sole treads vary. The boot sole pins 14 normally extend transversely across a front sole portion of the boot sole substantially parallel to and spaced part from one another. The boot pin or pins 14 clasp onto the different ski bindings that accommodate the different types of ski boots. Ski bindings 34 prevent skis 16 from popping off ski boots during the often demanding twists and turns of cross-country, backcountry touring, or other types of skiing. The boot sole guard 10 helps to keep the boot pins 14 and treads 17 of the front sole portion 15 of the ski boot soles 12 free of snow and other debris, which helps assure the good fit that is vital for holding the ski boots 11 in ski bindings 34. The ski bindings 34 are the fastening mechanisms on top of the skis used to fasten the ski boots to the skis (see FIG. 18).

Figure 4:
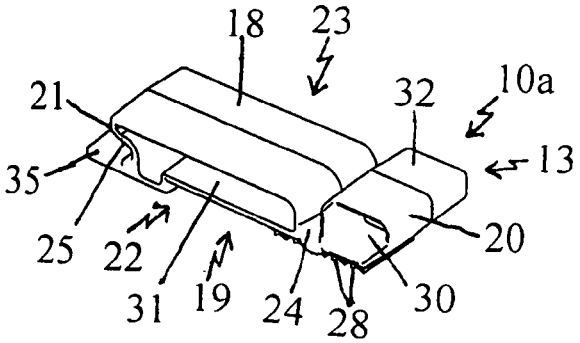
FIG. 4 is a upper perspective view of the ski boot sole guard of FIG. 3.
Figure 5:
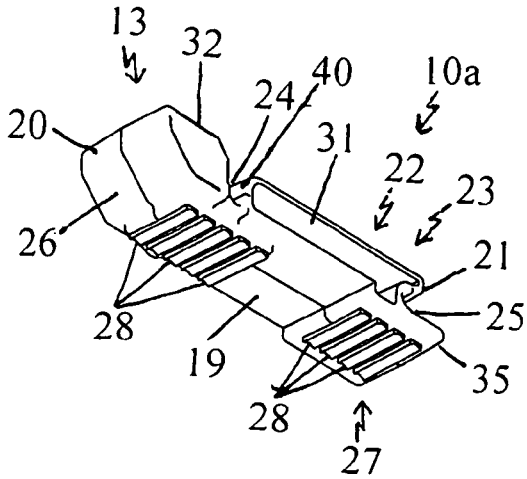
FIG. 5 is a lower perspective view of the ski boot sole guard of FIG. 3.
Figure 6:
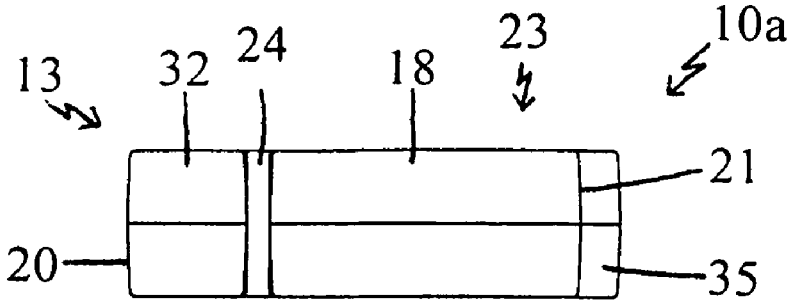
FIG. 6 is a top plan view of the ski boot sole guard of FIG. 3.
Figure 7:
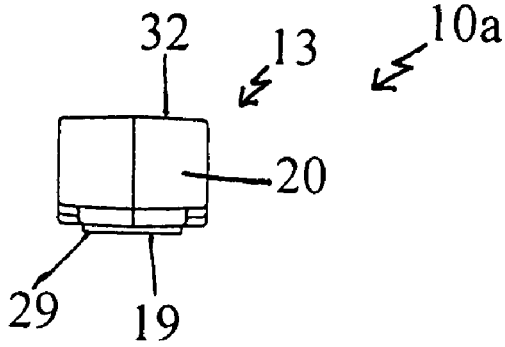
FIG. 7 is a front end view of the ski boot sole guard of FIG. 3.

As seen in FIGS. 3 through 7, a one-piece, reusable two-pin version 10*a* of the ski boot sole guard 10 includes: (a) a head portion 13 comprising a substantially planar top head surface 32 that is substantially parallel to an opposite, bottom surface 19 of the sole guard 10; (b) a body portion 23 adjacent the head portion 13, the body portion 23 comprising a substantially planar top body surface 18 that is substantially parallel to an opposite, bottom surface 19 of the sole guard 10; (c) at least two, and preferably only two, pin grooves 24, 25; (d) two opposite guard sides 22; and (e), a number of projections 27, preferably toothed segments 28, extending in a downward direction from the guard bottom surface 19. The guard sides 22 are preferably mirror-images of, and substantially parallel to, one another. Each guard side 22 is substantially perpendicular to the top body surface 18 and the bottom surface 19 of the sole guard 10. The top body surface 18 of the body portion 23 is preferably substantially smooth and rectangular in shape, as seen in FIG. 6. The head portion 13 includes a front end surface 20 that is opposite the rear end surface 21 of the sole guard 10. The front end surfaces 20 are generally visible to an observer when the sole guards 10 are in place on a pair of ski boots 11.

Figure 3:
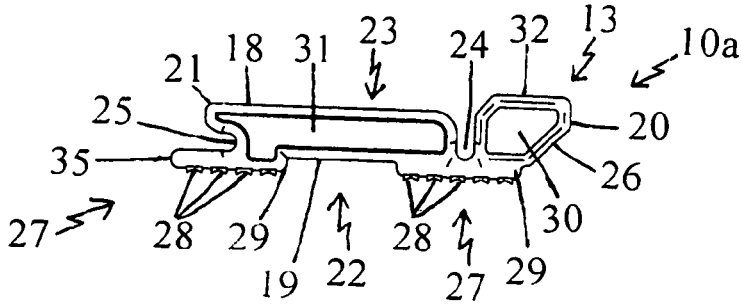
FIG. 3 is a right side elevational view of a two-pin ski boot sole guard according to the present invention.

As depicted in FIGS. 2 and 3, the first pin groove 24 extends down between the rear of the guard head portion 13 and the front of the body portion 23. The first pin groove 24 is formed by an invagination of the top surface of the sole guard 10*a*, and opens to the top of the sole guard 10. The second pin groove 25 extends in from the rear end surface 21 of the sole guard, and it opens to the rear of the sole guard. In the sole guard 10*a* shown in FIGS. 2 and 3, the second pin groove 25 extends substantially perpendicular to the first pin groove 24, which is toward the front of the sole guard 10. When the boot sole guard 10*a* is fitted on the ski boot 11, the second pin 14B of the ski boot 11 is pressed into the second pin groove 25, and the first pin 14A of the boot is then pressed into the first pin groove 24 of the sole guard 10*a*. Each pin groove 24, 25 at its bottom, then, is only slightly wider than the diameter of the boot pin 14 to ensure a close fit. Boot pins 14 on a boot are preferably about the same dimension as one another. The guard pin grooves 24, 25 preferably also have about the same dimensions as each other.

The pin grooves 24, 25 fit closely over the boot pins 14, so that the sole guard 10 essentially snaps, or pops, onto the boot pins 14. The snap fit secures the sole guard 10 firmly so that it will remain in place until it is removed. The snap also functions as an audible/sensory signal to the skier that the boot sole guard 10 is in place. The sole guard preferably includes a set of pin groove ridges 40 extending parallel to one another along opposite walls of the first pin groove just above where the boot pin 14A fits into the first pin groove 24. This set of pin groove ridges 40, which is preferably molded into both walls of the first pin groove 24, forms a narrow, pinched zone in the first pin groove 24 where the pin groove is slightly narrower than the boot pin 14, so that it takes a certain amount of pressure to pop the boot pin 14 into or out of the pin groove 24. The sole guard 10 will not come off until the skier removes it.

Even though it is durable and contacts the ground as the skier walks, the sole guard 10 is lightweight. As has been found herein, the boot sole guard 10 preferably includes several hollows in order to keep weight and costs down and to facilitate production of the preferred plastic-type sole guard 10, which is preferably injection molded. A first, head hollow 30 in the side of the head portion 13 is preferably substantially pentagonal (five-sided) in longitudinal cross-section, as seen in FIGS. 2 and 3. The preferred generally rectangular block-shaped body portion 23 also includes second, mirror image body hollows 31 disposed in each guard side 22. The body hollow 31 may instead extend through the sole guard from one side 22 to the other, or not. The head and body hollows 30, 31, or recesses, are open to the sides of the sole guard 10. The head and body hollows 30, 31 also provide for some flexibility in the sole guard, which is preferably made of a lightweight, durable, plastic material. The head and body portions 13, 23, with the pin groove 24 in between, also provide some flexibility, which is helpful over time in use, particularly since boot soles repeatedly flex as the wearer walks around. However, the guard material is sufficiently rigid that the head portion does not bend away from the body portion, and the pin groove does not serve as a hinge.

The sides of the head and body portions 13, 23 form the guard sides 22. In the two-pin sole guard 10*a* shown in FIGS. 2-7, the head portion 13 and the body portion 23 are preferably about the same width, the body portion 23 being longer than the head portion 13. The head portion 13 is taller than the body portion 23. If desired, letters or graphics, like logos or words, may be imprinted on or molded into the boot sole guard 10, as desired.

As seen in FIGS. 2 and 3, the top head surface 32 of the head portion 13 is above the level of the top body surface 18. The somewhat bulbous, or enlarged, head portion 13 fills the space between the sole guard 10 and the boot toe and extends above ground level, which helps prevent snow and other debris from collecting between the front of the sole guard 10 and the boot sole 12 when the sole guard is in use. The lower front surface 26 of the head portion 13, which extends down from the front end surface 20, is angled down and in to prevent the boot sole guard 10 from making walking ungainly by impeding the natural roll forward off the foot if the user was to walk with excess material and bulk. The blunt front end surface 20 and the angled in lower front surface 26 of the head portion 13 are also safety features, in case of inadvertent contact of the boot toe with a person's shin, etc.

The sole guards 10 include a number of small projections 27 extending down from their bottom surface 19. The projections 27 may simply be the raised points on an abraded surface. The projections 27 help grip the surface of the ground, which may be slick in places, as the wearer walks around. The projections 27 aid in gaining traction so the person walking around in ski boots 11 with sole guards 10 is less likely to slip and fall. The projections 27 are preferably spaced-apart toothed segments 28 that are substantially parallel to one another, as seen in the figures.

The toothed segments 28 extend from small, generally planar, slightly raised projection platforms 29 that are a part of the guard bottom surface 19. A preferred boot sole guard 10 has one platform 29 below the first pin groove 24 and one platform below the body portion 23 and the second pin groove 25, with space in between as seen in FIGS. 2 and 3. Each platform 29 most preferably holds between about four and about ten toothed segments at the bottom of the platform 29, although the number of teeth 28 may vary. Each platform 29 may support a different number or type of projections 27 from the other platform, or the teeth or other projections 27 on a set of boot sole guards 10 may all be the same. The platform 29/teeth are advantageous in that they provide a cushion that prevents the front of the boot sole 12 and the boot pins 14 from contacting the ground and wearing down. This is particularly important when walking on paved surfaces, which can be extremely abrasive on ski boots 11. When the sole guards are on the boots, the platforms 29 are beneath the boot pins 14 in order to ensure that the sole guard 10 has structural integrity and to prevent scratches and wear on the boot pins 14. The round surface of the boot pins 14 can cause them to be difficult to release from ski bindings 34 if the boot pin surface is marred and no longer smooth; protection of the boot pins is important for long boot life and proper fit of ski boots in ski bindings.

The skier normally snaps one boot sole guard 10 over a pin 14 or pins on a front portion of the sole 12 of each ski boot 11, preferably as soon as the ski boots 11 are put on. Placement in the front part of the boot sole is preferred because historically that is where snow and ice tend to be a worse problem. The removable guards 10 can be quickly and easily removed just prior to placing the ski boot 11 in ski bindings 34 (see FIG. 18). The boot sole guards 10 are reusable and can be reinserted once the skis 16 are removed after a ski outing. The boot sole guards 10 can be used for multiple outings or cross country races.

The boot sole guards 10 can be tailored to fit various types of ski boots 11. The ski boot 11 need not be specially made to accommodate the device of the present invention. Continuing with FIG. 2, one common type of ski boot 11 includes two short pins 14A, 14B, each of which extends between two corresponding treads 17 over a longitudinal midline channel in the sole 12. The removable ski boot sole guard 10*a* fits closely between corresponding sets of treads 17 on the front part of the boot sole 12 along the longitudinal midline channel. The boot pins 14 are normally substantially parallel to one another and to the surface of the boot sole 12 (where the treads originate). The boot sole guard 10*a* itself includes two sets of the pin grooves 24, 25, each of which clasps over a corresponding one of the boot pins 14A, 14B, respectively, as seen in FIG. 2. The boot sole guard 10 blocks the crevices between the boot treads 17 and under the boot pins 14, which prevents snow, ice, and debris from packing into those spaces as the wearer walks.

As seen in FIG. 2, except for the front protuberance, the dimensions of the ski boot guard 10*a* correspond to those of the recess, or space, between the boot treads 17 in the front part of the boot sole 12. The boot treads 17 bordering the sole guard 10 help to protect the boot sole guard 10, and the boot treads 17 and boot pins 14 prevent the sole guard 10 from inadvertently being knocked loose from its seat on the boot sole 12 as the wearer walks over smooth or rough ground. In ski boots 11 without a boot sole guard 10, this space at the front part of the ski boots quickly fills with snow and debris as the wearer walks around outside. It also gets scuffed and worn down over time. Protecting this boot sole recess with the boot sole guard 10 prevents the recess from filling with snow, ice, and debris that would otherwise have to be cleared out before the wearer can place her or his ski boots in ski bindings 34. When the boot sole guard 10 is in use, the bottom surface 19 of the sole guard 10 contacts the ground as the user walks around without skis. In the ski boot 11 of FIG. 2, the rear end surface 21 of the boot sole guard 10*a*, which faces the interior of the boot sole 12, is adjacent a sole tread 17. The top body surface 18 lies adjacent the sole 12 of the ski boot 11. When the boot sole guard 10 is on the sole, the guard sides 22 at the body portion 23 are also adjacent boot sole treads 17. The ski boot pins 14 lay in the first and second guard pin grooves 24, 25, respectively.

In addition to blocking snow and debris from packing into the crevices on the front part of the boot sole 12 that is covered by the boot sole guard 10, the boot sole guard 10 optionally includes a rear scraper 35 for removing snow/debris from the boot soles 12. The user may manipulate the boot sole guard 10 in one hand before putting it on the ski boot 11, using the scraper 35 on the rear end of the sole guard 10 to remove snow or ice anywhere. The sole guard edge can also be used to remove snow or ice from elsewhere on the boot sole 12 prior to locking the ski boots 11 into ski bindings 34, if desired. As seen in FIGS. 2-4, the scraper 35 extends out from the bottom portion of the rear of the boot sole guard 10 below and adjacent the second, rear guard pin groove 25. The scraper 35 extends beyond/is longer than the top body surface 18 on a lower plane than the top body surface, as seen in FIGS. 3, 5, and 6. The scraper 35 may have a rounded edge as depicted in FIGS. 2 and 3, or a sharper, blade edge. The scraper 35 preferably has the same width as the rest of the boot sole guard 10. The primary purpose of the boot sole guard 10, though, is to prevent ice, etc. from accumulating in the space the sole guard occupies, rather than being primarily intended for ice removal. Any model of the boot sole guard 10 may include a scraper, or not.

Although boot sole guard size may vary, preferred measurements for the two-pin boot sole guard 10*a* are as follows: from about 6 to about 28 centimeters in length, from about 1 to about 3 centimeters in height, and from about 2 to about 4 centimeters in width. Maximum sole guard length, then, is the entire length of the ski boot. An elongated sole guard fits along a central, longitudinal recess of the boot sole from the toe to the rear of the ski boot. Boot sole guard size depends on the type of ski boot to which it will be applied, and measurements of the boot sole space to be covered, among other things. Each pair of boot sole guards 10 has the same measurements (duplicates), so each one can be placed on the left or right boot. Preferably, the body portion 23 of the one-pin boot sole guard 10*b* is slightly longer (most preferably about ½ inch, or about 20%-30% longer) than the head portion 13, and the body portion 23 and head portion 13 are about equal in width. The head portion 13 is preferably between about 20% and about 30% taller than the height of the body portion 23 of the two-pin boot sole guard 10*a*. Guard measurements can vary, though.

Turning to FIGS. 8 through 11, a removable, reusable, one-piece one-pin ski boot sole guard 10*b* includes: (a) a head portion 13 comprising a substantially planar top head surface 32 that is substantially parallel to an opposite, bottom surface 19 of the boot sole guard 10; (b) a body portion 23 adjacent the head portion 13, the body portion 23 comprising a substantially planar top body surface 18 that is substantially parallel to the opposite, guard bottom surface 19, and to the top head surface 32, the guard bottom surface 19 extending along the bottom of both the head portion and the body portion; (c) a pin groove 24 between the head portion 13 and the body portion 23; (d) two opposite guard sides 22; (e) a sloped rear surface 36 connecting a posterior end of the top body surface 18 and a posterior end of the bottom surface 19; and (f) a number of projections 27 extending in a downward direction from the guard bottom surface 19 under the head portion 13 and the body portion 23. Preferably but not necessarily, the head portion 13 includes at least one hollow 30, and the body portion 23 includes at least one hollow 31. Production techniques may dictate a certain number and placement of hollows 30, 31.

Figure 10:
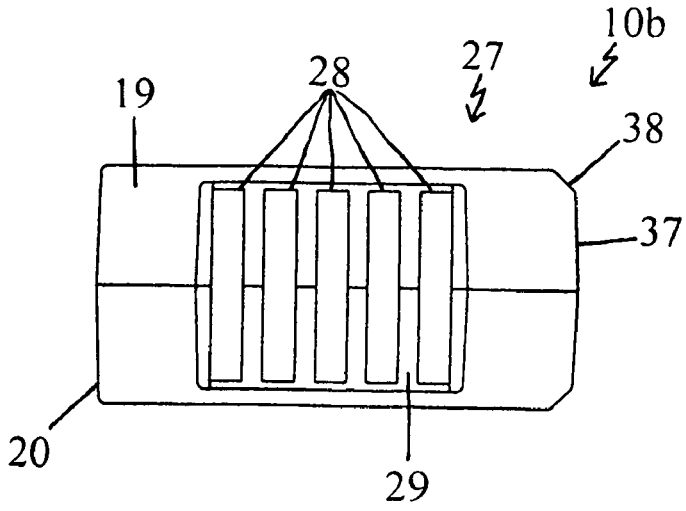
FIG. 10 is a bottom plan view of the ski boot sole guard of FIG. 8.

The guard sides 22 are preferably mirror-images of, and substantially parallel to, one another. Each guard side 22 is substantially perpendicular to the top body surface 18 and the bottom surface 19 of the boot sole guard 10. The guard bottom surface 19 is preferably substantially rectangular in shape, as seen in FIG. 10.

The top head surface 32 of the head portion 13 is preferably above the plane of the top body surface 18, a front end surface 20 of the head portion 23 being adjacent the lower, substantially planar, sloped front surface 26 of the head portion 13. The head portion 13 of the sole guard 10 is taller than the body portion 23, so that the front of the sole guard 10 juts forward from the boot toe in both the two-pin sole guard 10*a* of FIG. 2 and the one-pin sole guard 10*b* seen in FIG. 17. The front of the sole guard 10 juts out so that the wearer can push down on the projecting front portion of the one-pin or two-pin sole guard 10*a*, 10*b* with a ski pole, stick, hand, etc. when the wearer wishes to remove the sole guard 10 from the ski boot 11. The top body surface 18 is thus on a lower plane than the top head surface 32. The bottom surface 19 of the sole guard 10*a*, 10*b* is continuous/the same for both the head and body portions, so that a generally smooth walking surface is provided for the user. The head and body portions 13, 23 are of course connected below the (first) pin groove 24 in the one-pin and two-pin sole guards. The pin groove(s) adds flexibility to the piece/sole guard 10.

Figure 8:
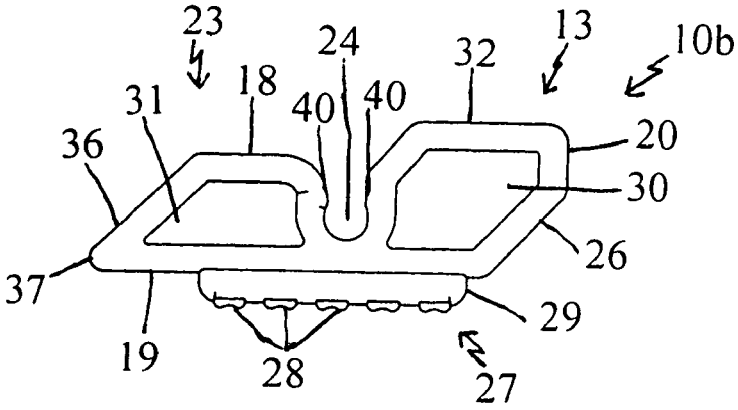
FIG. 8 is a right side elevational view of a one-pin ski boot sole guard according to the present invention.
Figure 9:
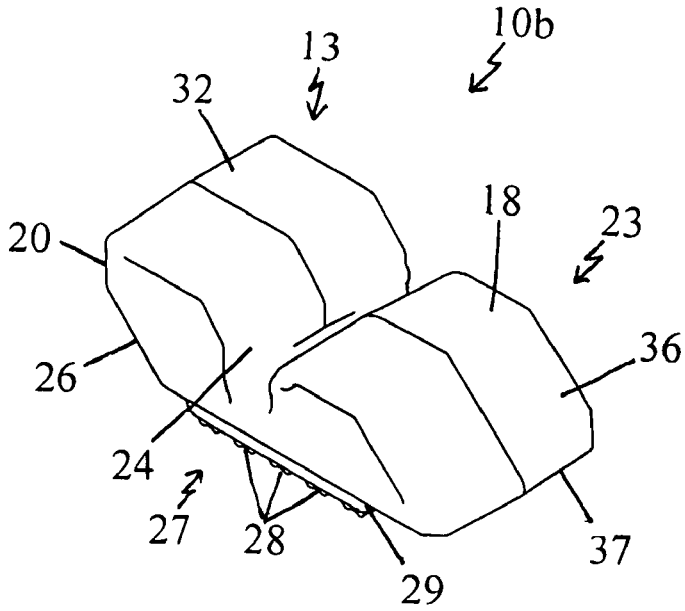
FIG. 9 is a top perspective view of the ski boot sole guard of FIG. 8.

As seen in FIG. 8, the head lower front surface 26 extends between the lower end of the front end surface 20 and the posterior end of the guard bottom surface 19. The head lower front surface 26 is preferably substantially parallel to the guard sloped rear surface 36. The substantially planar, sloped front surface 26 of the head portion 13 is angled in order to provide a smooth roll forward of the ski boot 11 while walking with the boot sole guard 10 in place. The guard rear surface 36 is angled, with the top body surface 18 adjacent the boot sole 12 to prevent snow accumulation, and with edge 37 forming a blade.

Figure 17:
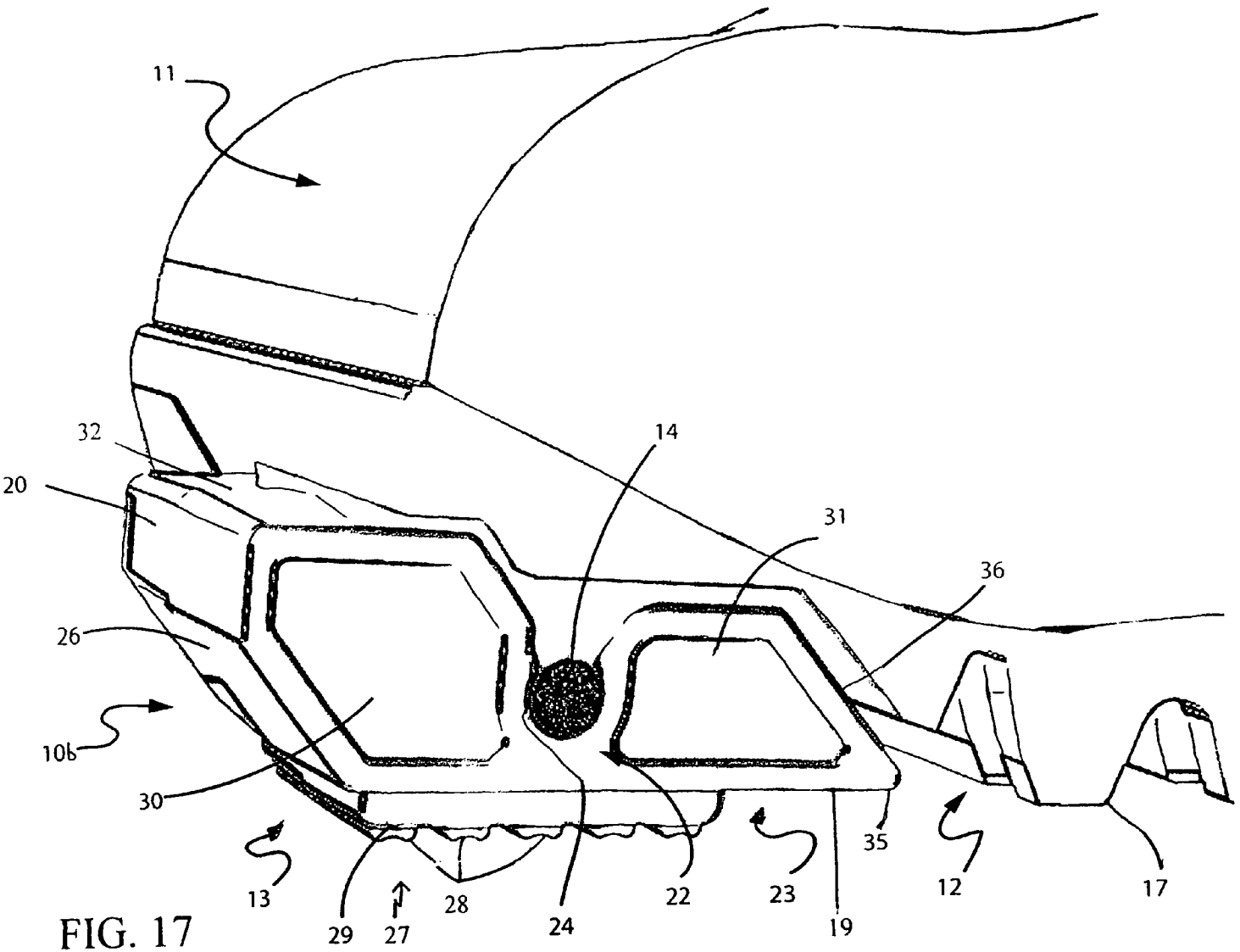
FIG. 17 is a perspective view of a one-pin ski boot sole guard according to the present invention, shown on a cross-sectioned ski boot.

The rear end surface 21 of the one-pin boot sole guard 10*b* is slanted to correspond to the slanted front face of the boot tread 17 that is adjacent the sole guard 10 when the sole guard is on the boot 11 (see FIG. 17). A close fit of the sole guard 10 in the boot sole recess is desirable in order to block snow and debris from entering the front boot sole recess that is occupied by the sole guard 10. The angle of the rear end surface 21 of the one-pin sole guard 10*b* (relative to the plane of the guard bottom surface 19) is preferably between about 30 and about 40 degrees, although it can be any other angle desired. Since the bottom of the ski pole 33 contacts the flat top head surface 32 of the head portion 13 when the user is removing the sole guard 10 (whether one-pin or two-pin) and since an overly protruded front end could interfere with the user's walking motion, the lower front surface 26 of the sole guard 10 is angled in as seen in FIGS. 2 and 17. The angle of the rear end surface 21 of the one-pin sole guard 10*b* corresponds to the angle of the lower front surface 26, which is also preferably between about 30 and about 40 degrees, relative to the plane of the guard bottom surface 19.

The projections 27 are preferably toothed segments 28 on a platform 29 on the bottom surface 19 of the one-pin guard 10*b*. The platform 29 preferably extends under the head portion 13, the pin groove 24, and the body portion 23. In the preferred guard shown in FIG. 8, the anterior end of the platform 29 lies adjacent the juncture of the lower end of the lower front surface 26 and the anterior end of the guard bottom surface 19.

The lower end of the sloped rear surface and the posterior end of the guard bottom surface 19 form a rear blade edge 37. The rear blade edge 37 can be used as a scraper, if desired. The blade edge 37 may be sharp or somewhat rounded. The user may manipulate the boot sole guard 10*b* with one hand prior to its placement on the boot sole 12, using the rear blade edge 37 of the boot sole guard 10*b* to remove snow or ice anywhere a small scraper is useful. The boot sole guard 10*b* can also be used to remove snow or ice from elsewhere on the boot sole 12 prior to locking the ski boots 11 into ski bindings, if desired.

Figure 18:
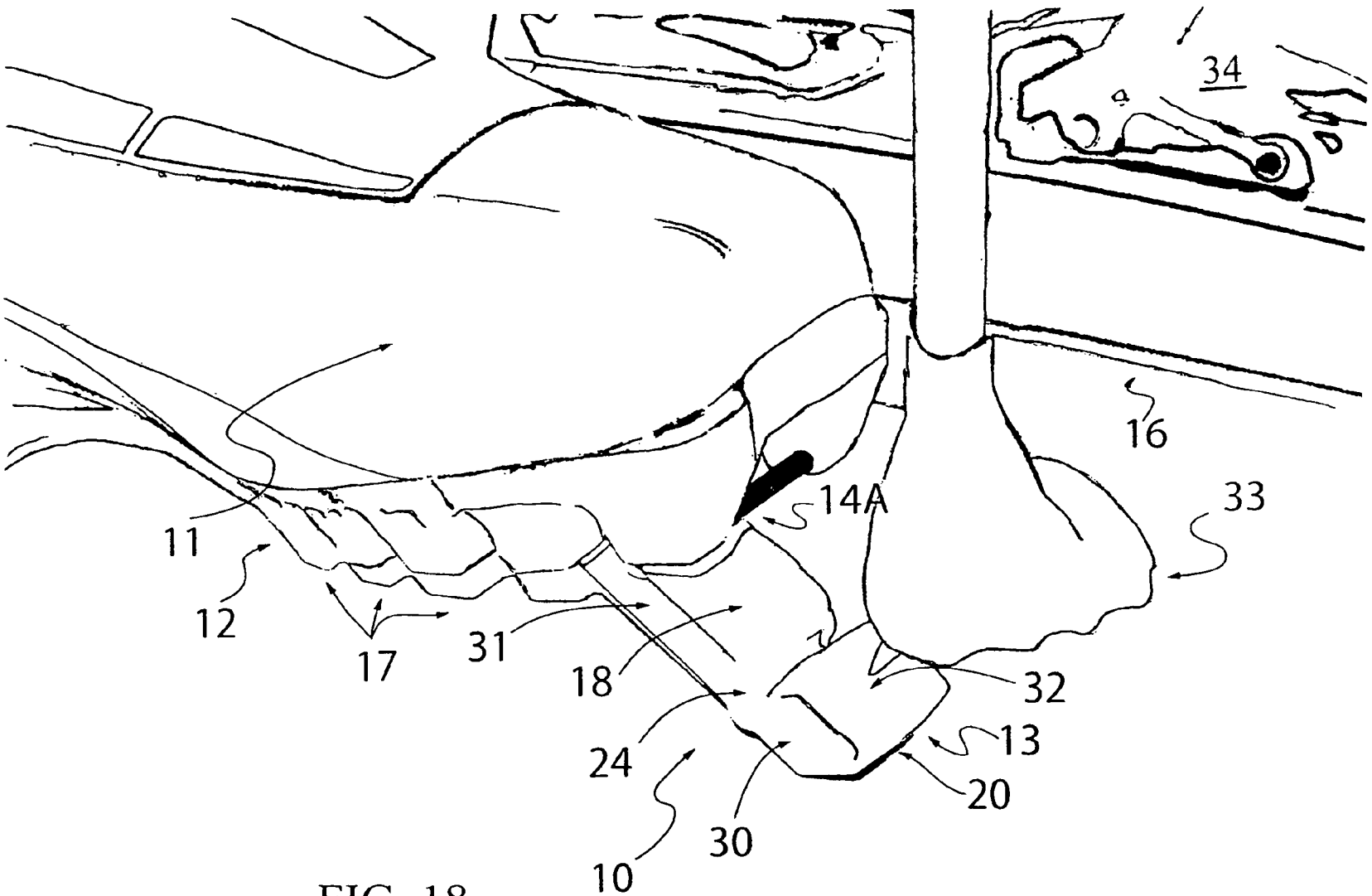
FIG. 18 is a perspective view of a ski boot sole guard according to the present invention, shown with a ski boot, a ski pole, and a ski.

When the skier is ready to remove the boot sole guard 10 from each ski boot, he or she need not sit down to do so. As seen in FIG. 18, the skier can instead use the end of a ski pole 33 to strike down on the exposed head portion 13 of each boot sole guard 10. This normally knocks at least the front of the two-pin boot sole guard 10 loose from the front boot pin 14A, as depicted in FIG. 18. The boot sole guard 10 is then pulled off, or falls off and is retrieved from the surface of the snow. Once the boot sole guard 10 is removed from the ski boot 11, the wearer places the ski boot 11 in ski bindings 34 on a snow ski 16 in preparation for skiing. The boot sole guard 10 is preferably neon or otherwise brightly colored to facilitate this procedure, and make the boot sole guard 10 easier to find when it falls in the snow or on the ground. The boot sole guards 10 are preferably color coded with a key to indicate to purchasers which colors go with which ski boot types.

Figure 11:
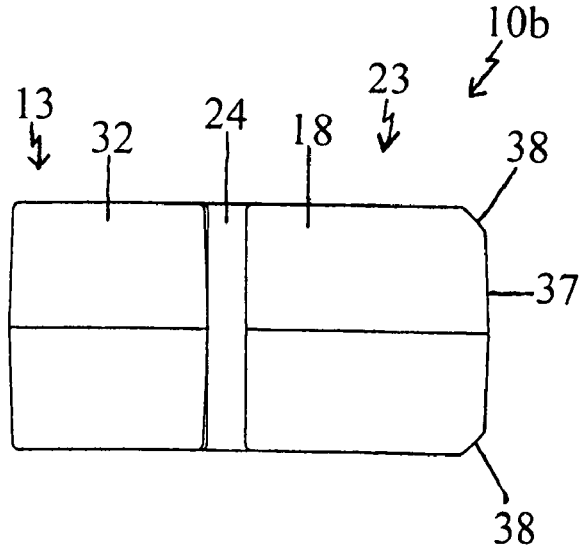
FIG. 11 is a top plan view of the ski boot sole guard of FIG. 8.
Figure 12:
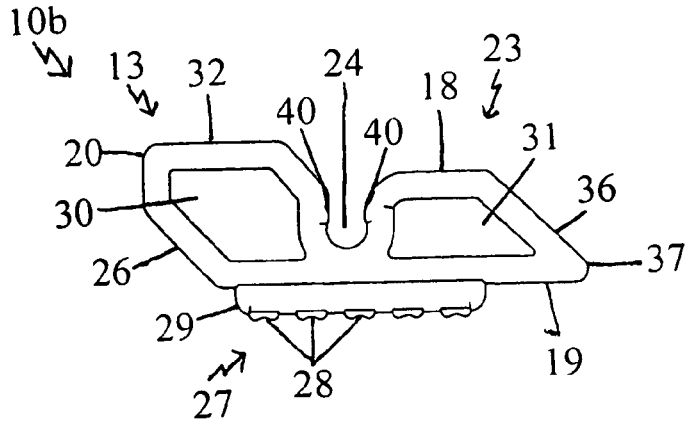
FIG. 12 is a left side elevational view of a one-pin ski boot sole guard according to the present invention.
Figure 13:
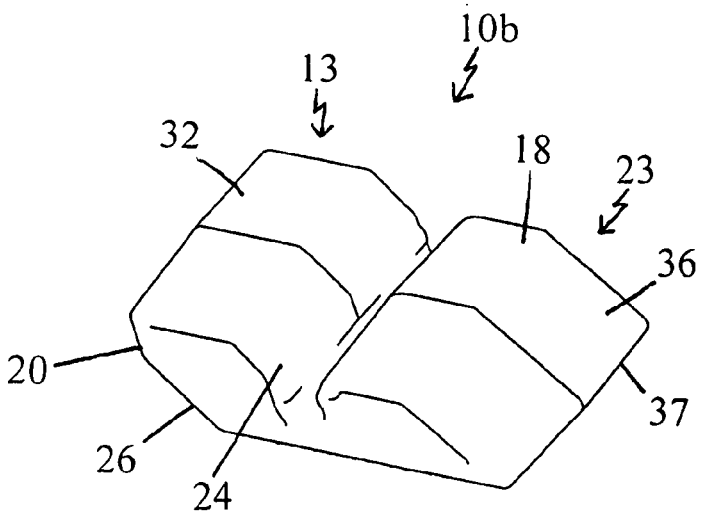
FIG. 13 is a top perspective view of the ski boot sole guard of FIG. 12.
Figure 14:
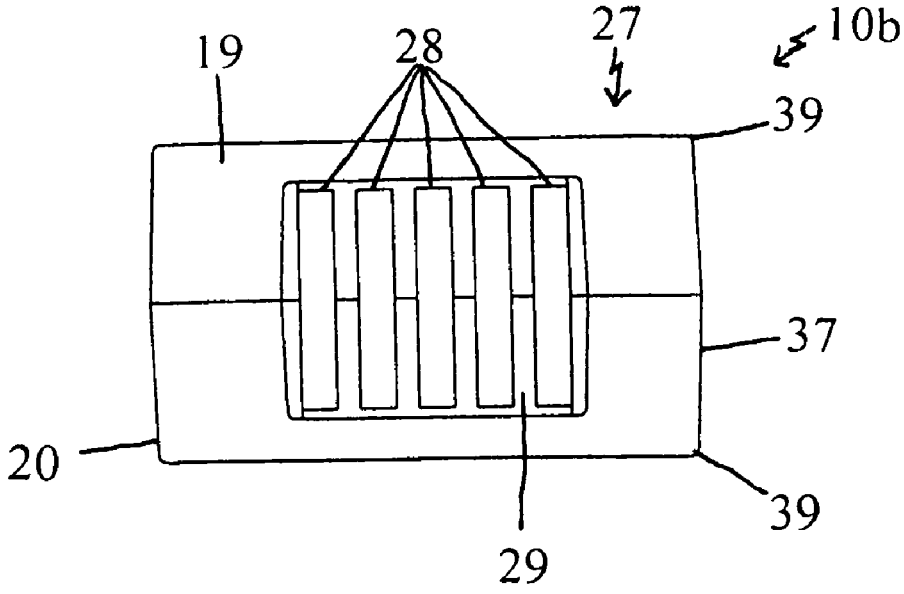
FIG. 14 is a bottom plan view of the ski boot sole guard of FIG. 12.
Figure 15:
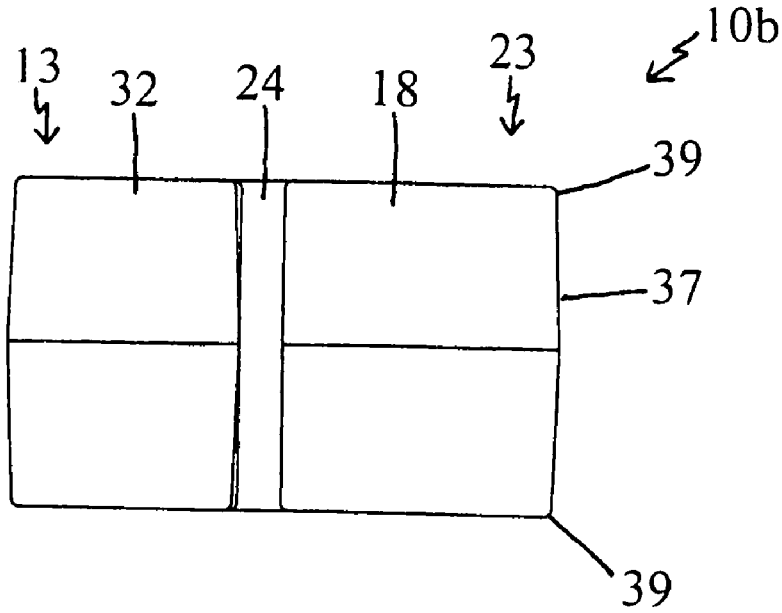
FIG. 15 is a top plan view of the ski boot sole guard of FIG. 12.
Figure 16:
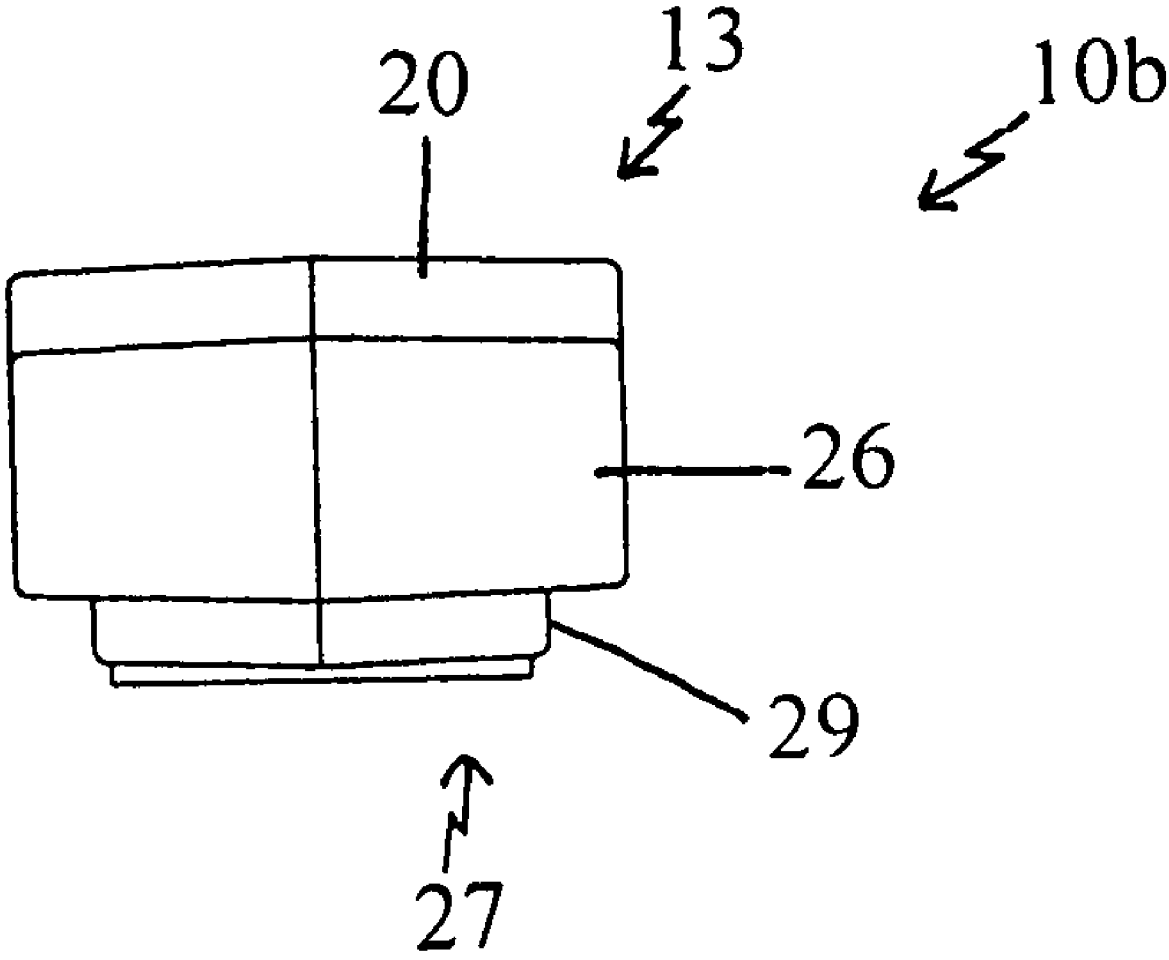
FIG. 16 is a front end view of the ski boot sole guard according to FIG. 12.

It can be seen that the one-pin boot sole guard 10*b* shown in FIGS. 12-16 is much the same as the second one-pin sole guard shown in FIGS. 8-11. However, the blade edge 37 of the first one-pin sole guard 10*b* (FIGS. 8-11) has angled outer corners 38, while the blade edge of the second one-pin sole guard (FIGS. 12-16) has sharper outer corners 39. These two one-pin guards 10*b* fit ski boot types that differ somewhat in their sole configurations. In the first one-pin guard (FIGS. 8-11), the outer corners 38 of the blade edge 37 are angled in (each about 45 degrees, as seen in FIGS. 10 and 11) so that the sole guard 10 fits between boot treads 17 of one type of ski boot. In the second one-pin guard (FIGS. 12-16), the outer corners 39 of the blade edge each form substantially a right angle so that the boot sole guard 10 corresponds to the shape of the boot treads of another type of boot, and fits consistently and accurately between them.

It can also be seen that the boot sole guard 10 can be adapted to fit over one or more or more pins 14 of a ski boot sole 12. As seen in FIG. 17, the one-pin ski boot guard 10*b* fits over one pin 14 on a ski boot sole 12. The one-pin sole guard 10*b* does not require a second pin groove 25 in order to fit this type of ski boot 11. The two-pin ski boot guard 10*a*, which is preferably about two or three times as long as the one-pin guard 10*b*, fits over two pins 14A, 14B on a ski boot sole 12. Although they are called herein "one-pin" and "two-pin" sole guards 10*a*, 10*b*, these boot sole guards do not themselves contain pins. Instead, they are formed to include pin grooves (or slots) that fit closely over the pin or pins of an existing ski boot. The snap fit holds the boot sole guard in place.

The one-piece, one-pin boot sole guard 10*b* includes one pin groove 24, which is an invagination of the top surface of the boot sole guard 10 at about the middle of the sole guard, as seen in FIG. 8. The pin groove 24 fits closely over the boot pin 14, so that the sole guard 10*b* essentially snaps onto the boot pin 14. The snap secures the sole guard 10 firmly so that it will remain in place until it is discharged. The snap also functions as an audible/sensory signal to the skier that the sole guard 10 is in place.

The pin groove 24 of a boot sole guard 10 is deeper if the pin 14A of a particular boot type is a greater distance from the surface of the boot sole 12. The depth of a pin groove 24 corresponds to the height of the pin 14A from the surface of the boot sole 12. If the pin 14 is closer to the boot sole surface, the pin groove 24, 25 is generally shallower.

The boot sole guard 10 preferably includes a pair of pin groove ridges 40 extending parallel to one another just above where the boot pin 14A fits when it is within the pin groove 24 on each pin groove wall. Each pin groove ridge 40 extends across the width of the sole guard 10, from guard side to guard side. This pair of pin groove ridges 40, which are preferably molded into the opposite walls of the pin groove 24, creates a narrow, pinched zone where the pin groove 24 is slightly narrower than the boot pin 14, so that the boot pin 14 is only popped into or out of the pin groove with slight application of pressure. The sole guard 10 will not come off the ski boot until the skier removes it.

When it is in use, the front of any boot sole guard 10 preferably extends slightly beyond the toe of the ski boot 11, so that the sole guard 10 can easily be removed from the ski boot (see FIGS. 1 and 17). The one-piece sole guard 10 can be removed by striking down on its top head surface 32 with the end of a ski pole 33, or with the heel of the opposite boot 11, if desired. Alternatively, the ski boot 11 can be lifted up so that the preferably brightly colored guard is clearly visible, and the sole guard 10 can then be pulled off the ski boot 11 using one hand.

The boot sole guards 10 are preferably made of an inexpensive but durable plastic material, such as polyethylene, polystyrene, or ABS (a copolymer of acrylonitrile, butadiene, and styrene), although any suitable material can be employed. The sole guard material withstands repeated bouts of freezing conditions and exposure to melt water. The rigid or semi-rigid plastic or other sole guard material is preferably brightly colored so that it is clearly visible on the ski boot, and shows up easily against snowy ground if it is inadvertently dropped. The skier can carry several boot sole guards 10 in one hand, a pocket, or a pouch or water bottle holder pack. The boot sole guards 10 are small, block-like, and lightweight; two boot sole guards 10 preferably easily fit in the palm of a hand.

Although sole guard size may vary, depending on the type of ski boot and measurements of the sole space to be covered, among other things, preferred measurements for a one-pin sole guard 10*b* are as follows: from about 4 to about 28 centimeters in length, from about 1 to about 2 centimeters in height, and from about 2 to about 4 centimeters in width. However, other sole guard measurements are also contemplated herein, such as an extended sole guard that extends between boot treads 17 the length of the ski boot 11. The body portion 23 and the head portion 13 are preferably about equal in width (see one-pin sole guard figures). Like the two-pin sole guard 10*a*, the height of the head portion 13 of the one-pin sole guard 10*b* is preferably between about 20% and about 30% greater than the height of the body portion 23 of the one-pin sole guard 10*b*, although the height may vary. Lastly, the projections 27 may be made of a different material than the sole guard material, such as metal spikes or studs.

The purpose of the ski boot sole guard 10 is to prevent snow, ice, and debris from accumulating in the boot recess so that the ski boot fits well in the ski bindings without undue scraping. The object of the present invention is not to enable a non-complying ski boot to comply with regulations. The boot sole guard 10 does not interfere with compliance of a ski boot with regulations. The sole guard 10 helps prevent scratches on the bottom of the ski boot, and extends the life of the ski boot and ski bindings. It may also be used with rollerski boots.

The ski boot sole guard 10 is not a cleat cover for providing a walking surface, as on a bicycle shoe or the like. The sole guard 10 is intended for use on ski boots 11 with boot pins 14, or rods, on the boot soles 12. The ski boot sole guard 10 is not a boot scraper that is mounted on or attachable to a ski, a ski pole, or a snowboard. The boot sole guard 10 does not include a spring or a like element. The one-piece boot sole guard 10 pops into place on the ski boot 11; no screws, snaps, hook and loop strips, friction strips, or other fasteners are required to hold the boot sole guard 10 in place. The boot sole guard 10 is not permanently mounted on the ski boot. The boot sole guards 10 are not toy building blocks and are not meant to attach, hinge, or lock to one another.

From the foregoing it can be realized that the described device of the present invention may be easily and conveniently utilized as a ski boot sole guard. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 ski boot sole guard
11 ski boot
12 boot sole
13 head portion
14 boot pins
16 skis
17 boot treads
18 top body surface
19 bottom surface
20 front end surface
21 rear end surface
22 sides of guard
23 body portion
24 first guard pin groove
25 second guard pin groove
26 lower, sloped front surface
27 projections
28 toothed segments
29 platform
30 head portion hollow
31 body portion hollow
32 top head surface
33 ski pole
34 ski bindings
35 scraper
36 planar, sloped rear surface
37 blade edge
38 angled corner of blade edge
39 sharp corner of blade edge
40 pin groove ridge

What is claimed is:

1. A one-piece, removable ski boot sole guard, comprising:

(a) a head portion comprising a substantially planar top head surface that is substantially parallel to an opposite, bottom surface of the boot sole guard;

(b) a body portion adjacent the head portion, the body portion comprising a substantially planar top body surface that is substantially parallel to an opposite, bottom surface of the boot sole guard;

(c) at least two pin grooves, a first, open-topped one of the pin grooves extending between the head portion and the body portion, a second one of the pin grooves extending in from a rear end surface of the boot sole guard at a different angle than the first pin groove;

(d) two opposite guard sides, the guard sides being substantially parallel to one another, and substantially perpendicular to the top body surface; and (e) a plurality of projections extending in a downward direction from the bottom surface of the boot sole guard.

2. The boot sole guard according to claim 1, wherein the head portion comprises at least one hollow disposed in a side of the head portion, and the body portion comprises at least one hollow disposed in a side of the body portion.

3. The boot sole guard according to claim 1, wherein the head portion comprises a substantially planar front end surface that is opposite the rear end surface of the boot sole guard; and wherein a plane of the top head surface of the head portion is above a plane of the top body surface of the body portion.

4. The boot sole guard according to claim 1, wherein the second pin groove opens to a rear of the boot sole guard and extends substantially perpendicular to the first pin groove, the first pin groove opening to a top of the boot sole guard.

5. The boot sole guard according to claim 3, wherein the front end surface is adjacent a lower, substantially planar, sloped front surface of the head portion, the lower, sloped front surface extending between a lower end of the front end surface and an anterior end of the guard bottom surface.

6. The boot sole guard according to claim 4, wherein the plurality of projections is substantially parallel toothed segments extending in a downward direction from the guard bottom surface.

7. The boot sole guard according to claim 1, further comprising a scraper adjacent the second pin groove, the scraper rear edge having substantially the same width as a width of the guard bottom surface.

8. The boot sole guard according to claim 2, wherein the at least one hollow in the guard head portion is substantially pentagonal in longitudinal cross-section; and wherein the body portion is generally rectangular block-shaped and comprises two mirror image ones of the at least one body hollow, with one of the at least one body hollows open to each guard side.

9. The boot sole guard according to claim 1, wherein the projections are substantially parallel toothed segments extending down from two spaced apart platforms of the guard bottom surface, with a first one of the platforms below the first pin groove and a second one of the platforms below the body portion and the second pin groove.

10. The boot sole guard according to claim 1, further comprising a scraper that extends out from a bottom portion of a rear of the boot sole guard below and adjacent the second, rear guard pin groove, the scraper extending longer than the top body surface on a lower plane than the top body surface.

11. The boot sole guard according to claim 1, further comprising a pair of corresponding pin groove ridges extending parallel to one another along opposite walls of the first pin groove, each of the pin groove ridges extending from one of the guard sides to the opposite guard side.

12. A one-piece, removable ski boot sole guard, comprising: (a) a head portion comprising a substantially planar top head surface that is substantially parallel to an opposite, bottom surface of the boot sole guard; (b) a body portion adjacent the head portion, the body portion comprising a substantially planar top body surface that is substantially parallel to the opposite, guard bottom surface, and to the top head surface, the guard bottom surface extending along a bottom of the head portion and the body portion; (c) a pin groove between the head portion and the body portion that opens to a top of the boot sole guard; (d) two opposite guard sides; (e) a sloped rear surface connecting a posterior end of the top body surface and a posterior end of the guard bottom surface; and (f) a plurality of projections extending in a downward direction from the guard bottom surface under the head portion and the body portion.

13. The boot sole guard according to claim 12, wherein the plurality of projections is a plurality of toothed segments extending from a bottom of a platform of the guard bottom surface, the plurality of toothed segments extending under the head portion, the pin groove, and the body portion.

14. The boot sole guard according to claim 12, wherein a top head surface of the head portion is above a plane of the top body surface of the body portion, a front end surface of the head portion being adjacent a lower, substantially planar, sloped front surface of the head portion, the head lower, sloped front surface extending between a lower end of the front end surface and an anterior end of the guard bottom surface.

15. The boot sole guard according to claim 12, wherein the head portion comprises at least one head hollow disposed in a side of the head portion, and the body portion comprises at least one body hollow disposed in a side of the body portion.

16. The boot sole guard according to claim 15, wherein the guard sides are mirror-images of, and substantially parallel to, one another, each guard side being substantially perpendicular to the top body surface and the guard bottom surface, the guard bottom surface being substantially rectangular in shape.

17. The boot sole guard according to claim 14, wherein the sloped rear surface and the lower, sloped front surface of the head portion are each angled relative to a plane of the guard bottom surface at an angle of between about 30 and about 40 degrees.

18. The boot sole guard according to claim 12, further comprising a scraper blade edge formed at a juncture of a lower end of a sloped rear surface of the body portion and a posterior end of the guard bottom surface.

19. The boot sole guard according to claim 18, wherein each of two outer corners of the blade edge form a right angle.

20. The boot sole guard according to claim 12, further comprising a pair of corresponding pin groove ridges extending parallel to one another along opposite walls of the pin groove, the pair of pin groove ridges forming a pinched zone in the pin groove, each of the pin groove ridges extending from one of the guard sides to the opposite guard side.

* * * * *